US011852990B2

(12) United States Patent
Zhou

(10) Patent No.: US 11,852,990 B2
(45) Date of Patent: Dec. 26, 2023

(54) COUNTING ASSEMBLY AND DEVELOPING BOX HAVING SAME

(71) Applicant: TOPJET TECHNOLOGY CO. LTD., Zhuhai (CN)

(72) Inventor: Xin Zhou, Zhuhai (CN)

(73) Assignee: TOPJET TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 17/758,008

(22) PCT Filed: Jun. 28, 2020

(86) PCT No.: PCT/CN2020/098419

§ 371 (c)(1),
(2) Date: Jun. 27, 2022

(87) PCT Pub. No.: WO2021/128780

PCT Pub. Date: Jul. 1, 2021

(65) Prior Publication Data

US 2023/0061656 A1 Mar. 2, 2023

(30) Foreign Application Priority Data

Dec. 27, 2019 (CN) ..... 201922429528.1
May 25, 2020 (CN) ..... 202020901141.1

(51) Int. Cl.
*G03G 15/08* (2006.01)
*G03G 15/00* (2006.01)

(52) U.S. Cl.
CPC ..... *G03G 15/0858* (2013.01); *G03G 15/55* (2013.01)

(58) Field of Classification Search
CPC .. G03G 15/0858; G03G 15/55; G03G 15/553; G03G 15/556
See application file for complete search history.

(56) References Cited

U.S. PATENT DOCUMENTS 2,746,464 A * 5/1956 Reis ..... G06M 1/04 453/35
3,201,040 A * 8/1965 Tomlin ..... B41L 39/02 235/132 R (Continued)

FOREIGN PATENT DOCUMENTS

CN 103713498 A 4/2014
CN 108037648 A * 5/2018 ..... G03G 15/0858

(Continued)

OTHER PUBLICATIONS

International Search Report in related International Application PCT/CN2020/098419 dated Oct. 12, 2020, pp. 1-6.

*Primary Examiner* — Carla J Therrien
(74) *Attorney, Agent, or Firm* — Pillsbury Winthrop Shaw Pittman, LLP; Chad Hammerlind

(57) ABSTRACT

Provided are a counting assembly and a developing box. The counting assembly comprises a counting member for attaching to and detaching from an external counted member; the counting member comprises a rotating member and a toggling member, the rotating member receives driving force from outside to rotate and the toggling member is driven to rotate; the counting assembly further comprises a holding member in contact with the rotating and toggling members. During counting, the rotating member applies a discontinuous acting force to the toggling member through the holding member; when applied with the acting force, the toggling member is kept by the holding member at a static position where the counted member is continuously pressed; when not applied with the acting force, the toggling member rotates under the action of the counter force of the counted member along a direction opposite to the rotating direction of the rotating member.

20 Claims, 10 Drawing Sheets

(56) References Cited

U.S. PATENT DOCUMENTS

| | | | | | |
|---|---|---|---|---|---|
| 3,641,322 | A | * | 2/1972 | Limberger | G03G 21/02<br>235/132 R |
| 3,916,167 | A | * | 10/1975 | Cook | G06M 3/021<br>399/361 |
| 4,516,498 | A | * | 5/1985 | Mistyurik | B65C 11/02<br>400/54 |

FOREIGN PATENT DOCUMENTS

| | | | | | |
|---|---|---|---|---|---|
| CN | 108873654 | A | * | 11/2018 | G03G 15/0858 |
| CN | 109188875 | A | | 1/2019 | |
| CN | 109240054 | A | * | 1/2019 | G03G 15/0858 |
| CN | 110244532 | A | | 9/2019 | |
| JP | 2019032379 | A | | 2/2019 | |

* cited by examiner

COUNTING ASSEMBLY AND DEVELOPING BOX HAVING SAME

CROSS-REFERENCE TO RELATED APPLICATIONS

The present application is a National Phase of International Application No. PCT/CN2020/098419, filed on Jun. 28, 2020, which claims priority to Chinese Application No. 201922429528.1, filed on Dec. 27, 2019, and Chinese Application No. 202020901141.1, filed on May 25, 2020, the contents of all of which are incorporated herein by reference in their entireties.

TECHNICAL FIELD

The present disclosure relates to the field of electrophotographic imaging, and in particular, to a developing box detachably installed in an imaging device and a counting assembly in the developing box.

BACKGROUND

A developing box is a necessary consumable in an operation process of an imaging device. In order to make the imaging device remind the end user of the remaining life of the developing box in time, the current developing box is usually provided with a counting assembly, and the imaging device is provided with a counted member which is combined with the counting assembly. The imaging device determines the life of the developing box based on the duration and the times of combination of the counting assembly and the counted member, and an interval between two adjacent combinations of the counting assembly and the counted member.

In order to improve the overall assembly convenience of the counting assembly and the developing box, a structure is provided in which a counting member in the counting assembly can be decomposed into a rotating member and a toggling member that are combined with each other. The rotating member is provided with a plurality of protrusions. When driven to rotate, the rotating member drives the toggling member to move, to cause the toggling member to be combined with the counted member. In actual applications, the current counting assembly has poor accuracy, which results in failure of counting.

SUMMARY

The present disclosure provides an improved counting assembly and a developing box including the counting assembly. The present disclosure adopts the following technical solutions.

A counting assembly includes a counting member capable of being engaged with and disengaged from a counted member that is arranged outside the counted member. The counting member includes a rotating member and a toggling member separated from each other, the rotating member rotates by receiving an external driving force, and the rotating member drives the toggling member to rotate. The counting assembly further includes a holding member in contact with the rotating member and the toggling member. During a counting process, the rotating member applies a discontinuous force to the toggling member through the holding member; and when the toggling member is subjected to the force, the toggling member is held at a stationary position where the counted member is continuously pressed by the holding member. When the toggling member is not subjected to the force, the toggling member rotates along a direction opposite to a rotating direction of the rotating member under a reaction force of the counted member.

During a process that the rotating member applies the force to the toggling member through the holding member, as the rotating member rotates, the force applied by the rotating member to the toggling member increases.

In an embodiment of the present disclosure, the holding member includes protrusions which are provided at the rotating member and spaced from one another and a bump provided at the toggling member, and during a rotating process of the rotating member, when the bump is in contact with the protrusions, the rotating member transmits the force to the toggling member, and when the bump is not in contact with the protrusions, the rotating member does not transmit the force to the toggling member.

The bump and the protrusions are eccentrically arranged. In this case, the bump is in contact with an outer surface of one of the protrusions, and a contact point thereof is within a circumference of the rotating member. Alternatively, along the rotating direction of the rotating member, a starting point of each of the protrusions is closer to a rotation center of the rotating member than an ending point of the protrusion. The protrusions are provided at a rotating body of the rotating member. In a radial direction of the rotating member, the protrusions extend beyond the rotating body, and along the rotating direction of the rotating member, a protruding extent of each of the protrusions decreases. Alternatively, a surface on which the bump and one of the protrusions are in contact with each other is configured in such a manner that, an upstream edge of the surface is farther away from a rotation axis of the toggling member than a downstream edge of the surface along a rotating direction of the toggling member when the rotating member drives the toggling member to rotate. Alternatively, at least one of a surface on which the bump and one of the protrusions are in contact with each other and the outer surface of one of the protrusions is configured to be elastic, and when the rotating member rotates, the toggling member is held at a stationary position where the counted member is pressed by the toggling member through a static friction force between the rotating member and the toggling member.

In another embodiment of the present disclosure, the holding member includes protrusions which are provided at the rotating member and spaced from one another and an elastic member provided between the rotating member and the toggling member. The elastic member is in contact with the protrusions and the toggling member. In this case, a circle center of a circle along which the elastic member performs a circular motion is not concentric with a circle center of a circle along which the protrusions perform a circular motion. Alternatively, along the rotating direction of the rotating member, a starting point of each of the protrusions is closer to the rotation center of the rotating member than an ending point of the protrusion. Alternatively, a surface on which the bump and one of the protrusions are in contact with each other is configured in such a manner that, an upstream edge of the surface is farther away from a rotation axis of the toggling member than a downstream edge of the surface along a rotating direction of the toggling member when the rotating member drives the toggling member to rotate.

The present disclosure further provides a developing box including the counting assembly described above.

As described above, the counting assembly provided by the present disclosure utilizes the holding member in contact with the toggling member and the rotating member to hold the toggling member at a stationary position where the counted member can be continuously pressed, thereby improving the accuracy of the counting assembly and reducing a risk of counting failure.

DESCRIPTION OF EMBODIMENTS

With reference to the accompanying drawings, the embodiments of the present disclosure will be described in detail as below.

Embodiment 1

Entire Structure of Developing Box

Figure 1A:
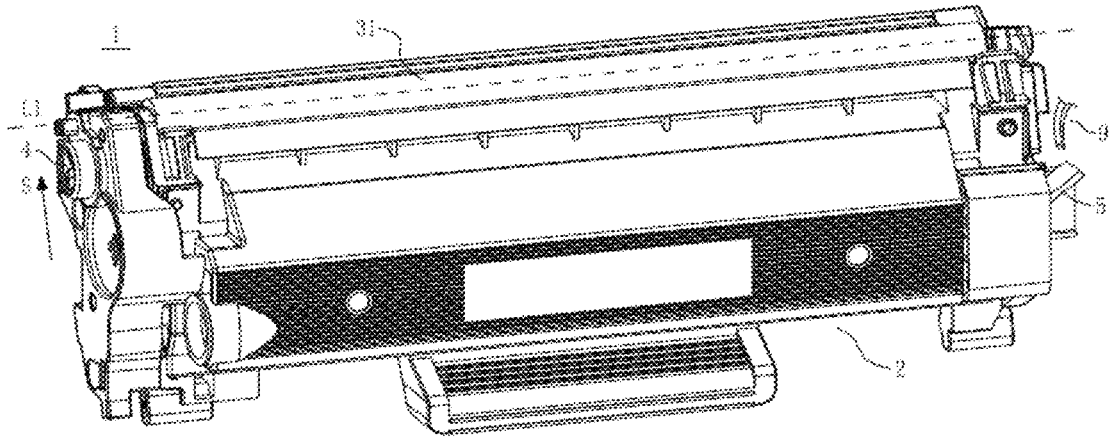
FIGS. 1A and 1B are perspective views of a developing box according to an embodiment of the present disclosure.
Figure 1B:
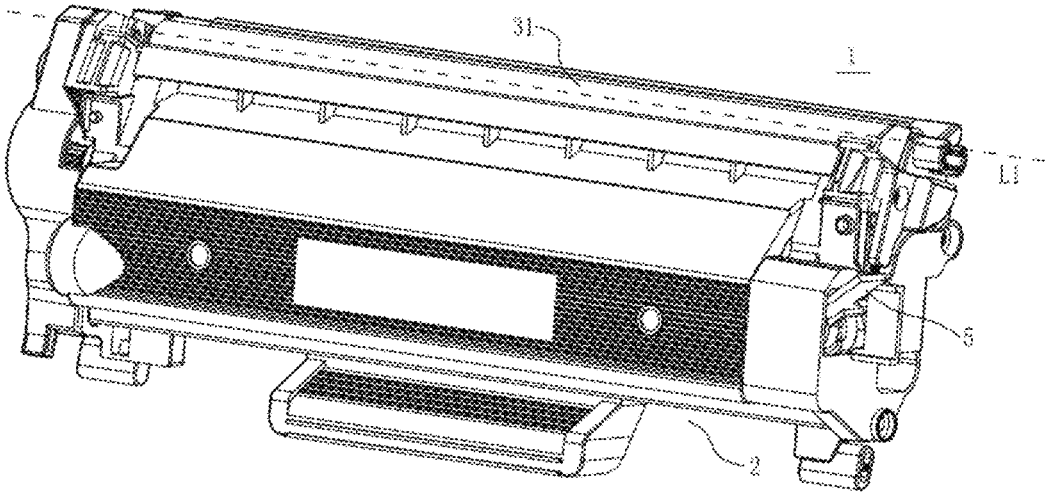
Figure 2:
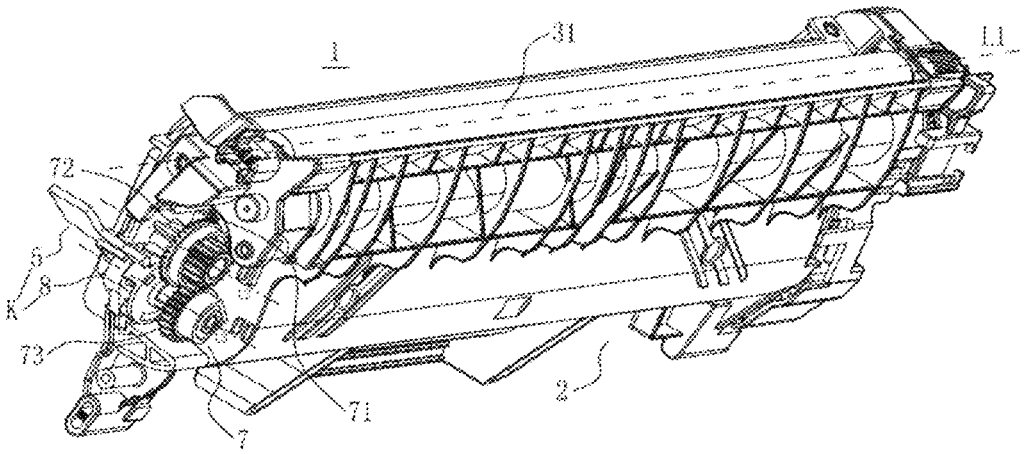
FIG. 2 is a perspective view of a developing box viewed from a counting end according to an embodiment of the present disclosure.

FIGS. 1A and 1B are perspective views of the developing box according to an embodiment of the present disclosure. FIG. 2 is a perspective view of a developing box viewed from a counting end according to an embodiment of the present disclosure.

A developing box 1 includes a housing 2, a developing member 31 rotatably installed in the housing 2, a power receiving member 4 and a toggling member 5 that are arranged at a longitudinal end of the housing. A side where the toggling member 5 is located is a counting end. When the developing box 1 is detachably installed, along a mounting direction S, into an imaging device provided with a counted member 9, the power receiving member 4 receives a driving force from the imaging device and transmits the driving force to a developing member 31 and the toggling member 5. Thus, the developing member 31 is rotatable about a rotation axis L1.

The toggling member 5 is configured to toggle the counted member 9, so that the imaging device is capable of identifying the developing box 1 and determining a service life of the developing box 1 according to a duration and times that the counted member 9 is pressed by the toggling member 5 and an interval between each two adjacent pressings. Once the toggling member 5 no longer applies a pressing force to the counted member 9, the counted member 9 rebounds and is reset.

In this embodiment of the present disclosure, the toggling member 5 and the power receiving member 4 are respectively located at two longitudinal ends of the housing 2, that is, the toggling member 5 and the power receiving member 4 are arranged at two different sides, so that the toggling member 5 is capable of receiving the driving force of the power receiving member 4. As shown in FIG. 2, the side where the toggling member 5 is located is the counting end. The developing box 1 further includes a gear set 7 and a rotating member 8 that are arranged at the same side as the toggling member 5. The gear set 7 receives the driving force of the power receiving member 4, and the rotating member 8 is engaged with the toggling member 5 and the gear set 7, respectively. Therefore, the driving force of the power receiving member 4 is transmitted to the toggling member 5 through the gear set 7 and the rotating member 8.

The rotating member 8 is configured to control the duration and the times that the counted member 9 is pressed by the toggling member 5 and the interval between each two adjacent pressings. Therefore, the rotating member 8 and the toggling member 5 can be collectively referred to as a counting member K. The gear set 7 includes a first gear 71 configured to receive a driving force, a transforming gear 72 and a driving gear 73. The first gear 71 receives the driving force of the power receiving member 4, and a rotation axis of the first gear 71 is parallel to the rotation axis L1 of the developing member 31. A rotation axis L2 of the transforming gear 72 and a rotation axis L3 of the driving gear 73 are both perpendicular to the rotation axis L1, and the driving gear 73 is coaxial with the rotating member 8, that is, the rotating member 8 is directly driven by the gear 73 to rotate about the rotation axis L3.

Counting Member

Figure 3:
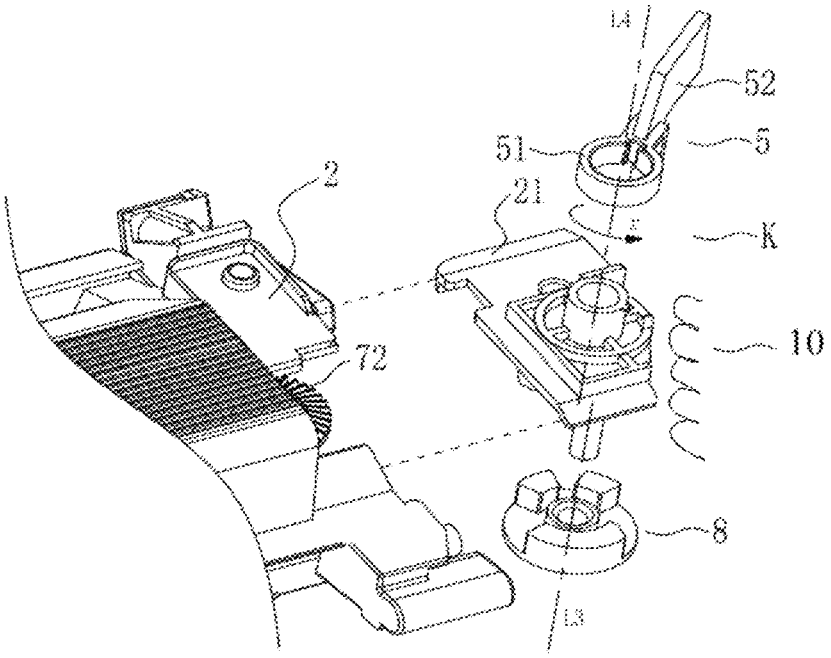
FIG. 3 is a status diagram illustrating a case in which a counting member in a developing box is disengaged from a housing of the developing box according to Embodiment 1 of the present disclosure.
Figure 4A:
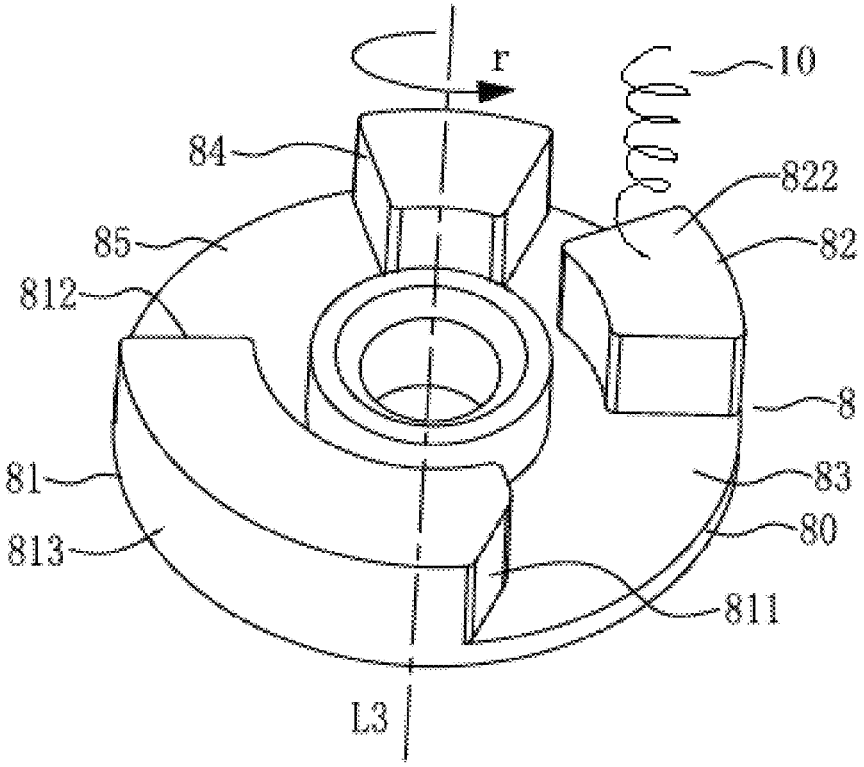
FIG. 4A is a perspective view of a rotating member in the counting member according to Embodiment 1 of the present disclosure.
Figure 4B:
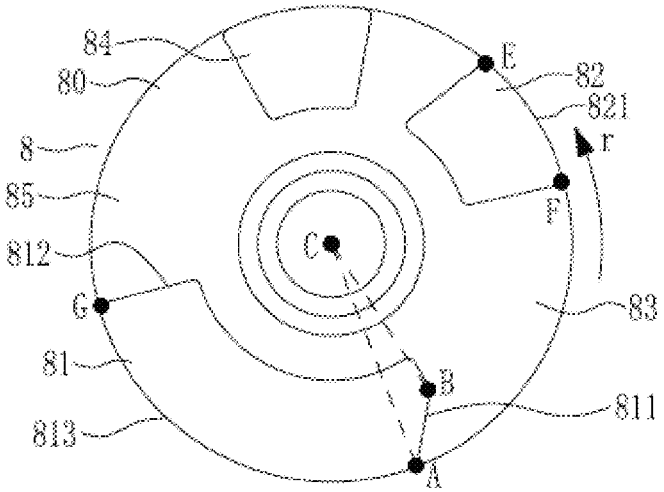
FIG. 4B is a top view of the rotating member in the counting member according to Embodiment 1 of the present disclosure.
Figure 5:
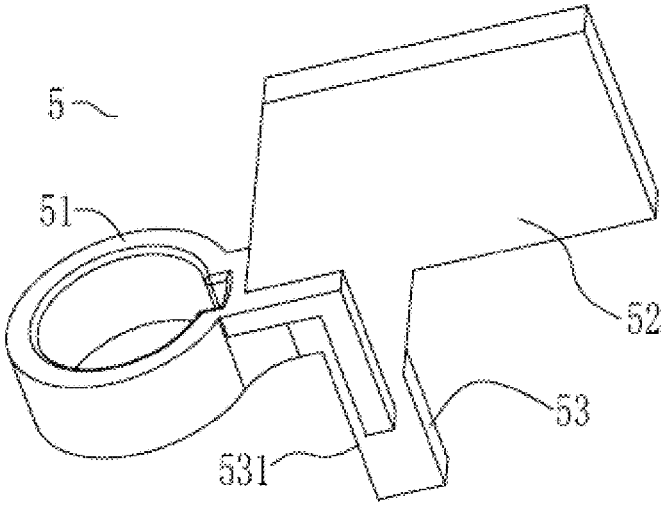
FIG. 5 is a perspective view of a toggling member in the counting member according to Embodiment 1 of the present disclosure.

FIG. 3 is a status diagram illustrating a case in which a counting member in a developing box is disengaged from a housing of the developing box according to Embodiment 1 of the present disclosure. FIG. 4A is a perspective view of a rotating member in the counting member according to Embodiment 1 of the present disclosure. FIG. 4B is a top view of the rotating member in the counting member according to Embodiment 1 of the present disclosure. FIG. 5 is a perspective view of a toggling member in the counting member according to Embodiment 1 of the present disclosure.

As shown in FIG. 3, the counting member K is installed to the housing 2 through an installation plate 21, so that the rotating member 8 rotates about the rotation axis L3, and the toggling member 5 rotates about the rotation axis L4. In this embodiment, the rotation axis L3 and the rotation axis L4 is not collinear. In this embodiment, the rotation axes L3 and L4 are parallel to each other. That is, the rotation axis L4 and the rotation axis L1 are also perpendicular to each other, and the rotating member 8 and the toggling member 5 are eccentrically arranged. As shown in FIG. 6B, the rotation center C of the rotating member 8 does not coincide with the rotation center D of the toggling member 5.

As shown in FIGS. 4A and 4B, the rotating member 8 includes a rotating body 80 and a plurality of protrusions which are provided on the rotating body 80 and spaced from one another. According to the difference of the service life of the developing box 1, the number of the protrusions and a space/distance between adjacent protrusions vary, but a working process thereof is similar. According to this embodiment of the present disclosure, in an example, the rotating body 80 is provided with three protrusions.

As shown in the figures, a first protrusion 82, a second protrusion 81 and a third protrusion 84 are spaced from one another along a circumferential direction of the rotating body 80. A first space 83 is formed between the first protrusion 82 and the second protrusion 81, and a second space 85 is formed between the second protrusion 81 and the third protrusion 84. The first protrusion 82 includes a first outer surface 821, the second protrusion 81 includes a second outer surface 813, and each of the first outer surface 821 and the second outer surface 813 is located at a radial outer side of the corresponding protrusion.

Taking the first protrusion 82 and the second protrusion 81 as an example, as shown in FIG. 4B, along a rotating direction r, a projection of a contact surface between the first protrusion 82 and the toggling member 5 along a circumferential direction of the rotating body 80 includes a starting point E and an ending point F, and a projection of the second protrusion 81 along the circumferential direction of the rotating body 80 includes a starting point A and an ending point G. Meanwhile, along the rotating direction r, each protrusion further includes a starting surface located in the most downstream and an ending surface located in the most upstream. For example, the second protrusion 81 includes a starting surface 811 and an ending surface 812. Further, the starting surface of each protrusion is formed as an inclined surface, indicating that: when the protrusion is projected on the rotating body 80 along the rotation axis L3 (a same plane perpendicular to the rotation axis L3), along the rotating direction r, an endpoint of the projection of the protrusion close to the rotation center C is located downstream of an endpoint of the projection of the protrusion away from the rotation center C. As shown in the figure, a projection of the starting surface 811 of the second protrusion on the rotating body 80 includes an endpoint A and an endpoint B, and a connecting line AB between the endpoints A and B is an inclined line, that is, along the rotating direction r, the endpoint B close to the rotation center C is located downstream of the endpoint A away from the rotation center C. The configuration of the inclined surface allows the toggling member 5 to be more smoothly disengaged from the starting surface of the protrusion and then enter a position in contact with an outer surface of the protrusion.

The toggling member 5 includes a base 51 that is rotatable, and a toggling plate 52 and a bump 53 that protrude outward from the base 51. When the rotating member 8 drives the toggling member 5 to rotate, the toggling plate 52 and the bump 53 move with the rotation of the base 51, the toggling plate 52 is engaged with the counted member 9, and the bump 53 is controlled by the rotating member 8 to make the toggling member 5 be stationary or move. In an example, an inner surface 531 of the bump 53 is controlled by the rotating member 8, when the rotating member 8 controls the bump 53 to keep the toggling member 5 stationary, the toggling plate 52 keeps pressing the counted member 9; and when the rotating member 8 controls the bump 53 to make the toggling member 5 move, the toggling plate 52 no longer presses the counted member 9, but is forced to move along a direction opposite to the rotating direction r by a reaction force of the counted member 9.

Counting Process of Counting Member

Figure 6A:
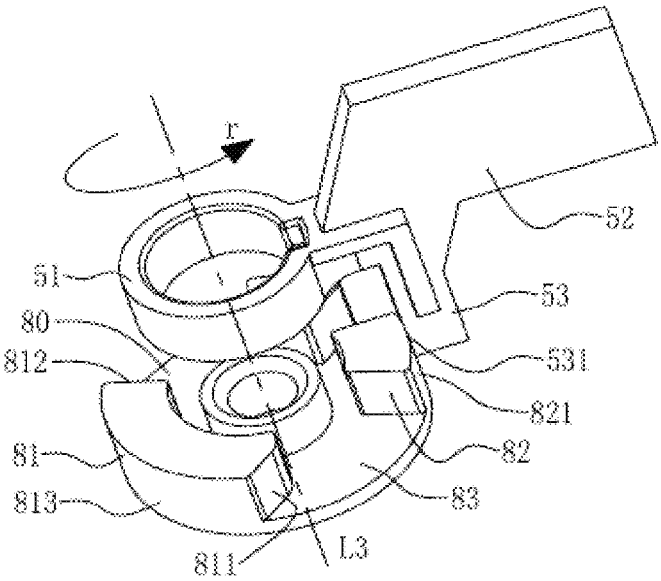
FIG. 6A is a perspective view of the counting member at an initial status according to Embodiment 1 of the present disclosure.
Figure 6B:
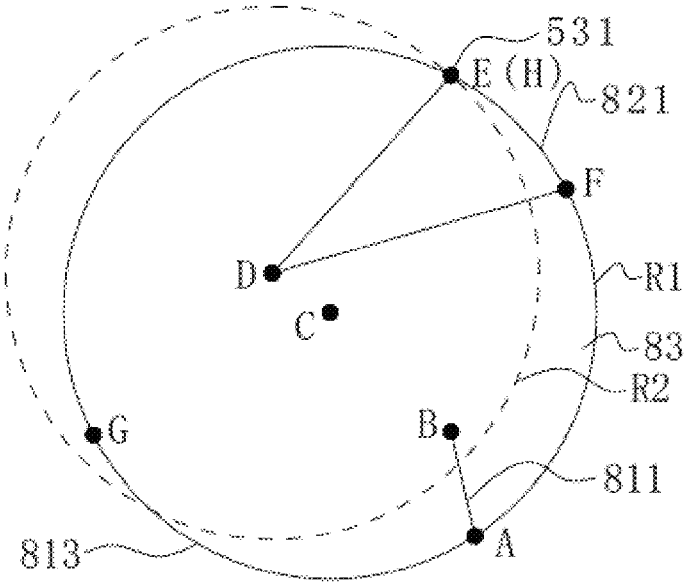
FIG. 6B is a simplified plan view of the counting member at the initial status according to Embodiment 1 of the present disclosure.

FIG. 6A is a perspective view of the counting member at an initial status according to Embodiment 1 of the present disclosure. FIG. 6B is a simplified plan view of the counting member at the initial status according to Embodiment 1 of the present disclosure.

During the counting process of the counting member K, the bump 53 is engaged with the protrusion, and when the bump 53 is engaged with the outer surface of the protrusion, the bump 53 (the toggling member 5) remains stationary. In order to describe the motion process of the rotating member 8 and the toggling member 5 more clearly, a rotation trajectory of the outer surface of the rotating member 8 is represented by a solid-line circle R1 with a circle center C, and to motion trajectory of the inner surface 531 of the bump 53 is represented by a dashed-line circle R2 with a circle center D. The circle center C and the circle center D are eccentric, and the eccentricity is configured in such a manner that during the counting process of the counting member K, the inner surface 531 is in contact with the outer surface of the rotating member 8, or the inner surface 531 is located at an inner side of the outer surface of the rotating member 8, that is, the inner surface 531 is located within a range of a circumference of the rotating member 8. When the solid-line circle R1 and the dashed-line circle R2 have a same radius, the two circles have intersections.

Further, as shown in FIG. 6B, when the inner surface 531 and the protrusion are projected on the rotating body 80, in order to simplify the representation, the first protrusion 82 (the outer surface 821 of the first protrusion) is simplified as an arc formed by a starting point E to an ending point F, and the second protrusion 81 (the outer surface 813 of the second protrusion) is simplified as an arc formed by a starting point A to an ending point G, and the starting surface 811 is simplified as a straight line AB formed by the starting point A to an ending point B which is closer to the circle center C than the starting point A.

As shown in FIG. 6A, before the counting member K starts counting, or in other words, when the developing box 1 is just installed to the imaging device, the inner surface 531 of the bump 53 is in contact with the outer surface 821 of the first protrusion 82, and the counted member 9 is pressed by the toggling plate 52, so that the imaging device determines that the developing box 1 has been installed. With reference to FIG. 6B, a contact point H of the bump 53 (toggling member 5/inner surface 531) and the outer surface 821 of the first protrusion coincides with the starting point E of the first protrusion 82. Therefore, the bump 53 remains stationary through the inner surface 531 by the protrusion 82, and the toggling plate 52 keeps pressing the counted member 9.

When the power receiving member 4 receives a driving force and drives the rotating member 8 to rotate about the rotation axis L3 along a direction r, the inner surface 531 keeps in contact with the outer surface 821 of the first protrusion, and the first protrusion 82 applies a holding force to the inner surface 531 of the toggling member 5 to make the toggling member 5 remain in a stationary position. Although the counted member 9 applies a force to the toggling member 5 along a direction opposite to the rotating direction r, a motion trend of the toggling member 5 along the direction opposite to the rotating direction r is prevented by the first protrusion 82, therefore, the toggling member 5 remains stationary as an entirety and continuously presses the counted member 9. As the rotating member 8 rotates, the contact point H of the two gradually approaches the ending point F of the outer surface 821 of the first protrusion. As shown in FIG. 6B, a distance DF from the circle center D of the toggling member 5 to the point F is greater than a distance E from the circle center D to the point E. As the rotating member 8 rotates, the holding force applied by the first protrusion 82 to the toggling member 5 gradually increases. In this way, the toggling member 5 can be stably held in a stationary position where the counted member 9 is pressed. When the rotating member 8 rotates until the outer surface 821 of the first protrusion no longer contacts the inner surface 531, that is, the contact point H no longer contacts the ending point F, the first protrusion 82 no longer prevents the toggling member 5 from moving along the direction opposite to the rotating direction r, and the projection 53 moves within the first space 83 about the rotational axis L4 along the direction opposite to the rotating direction r.

Figure 7A:
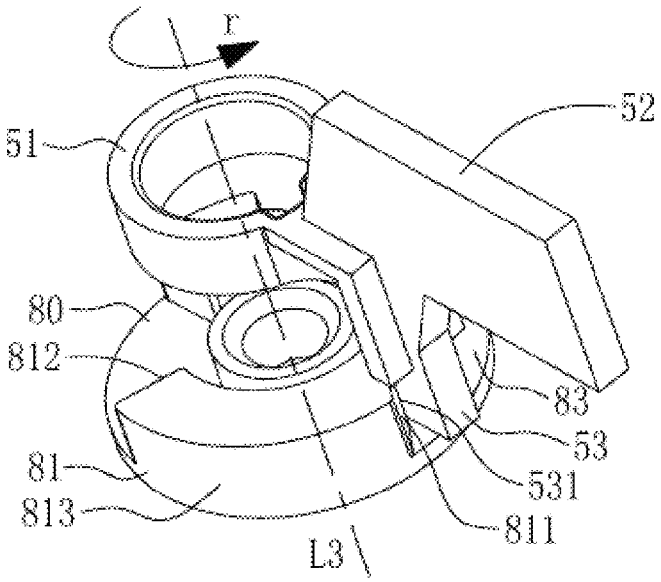
FIG. 7A is a perspective view of the counting member after a first holding period according to Embodiment 1 of the present disclosure.
Figure 7B:
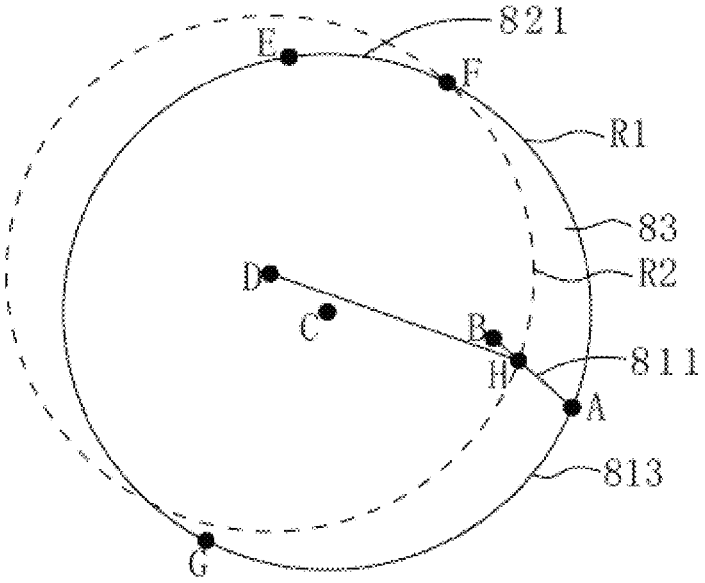
FIG. 7B is a simplified plan view of the counting member after the first holding period according to Embodiment 1 of the present disclosure.
Figure 8A:
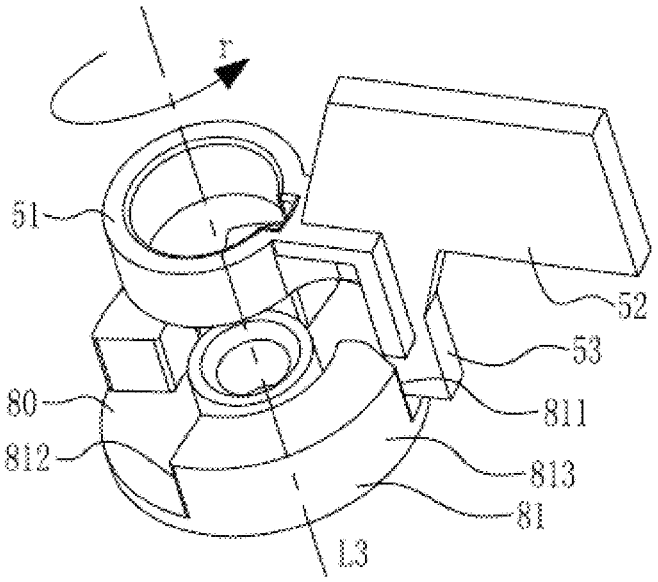
FIG. 8A is a status diagram illustrating a case in which the toggling member in the counting member rotates with a second protrusion according to Embodiment 1 of the present disclosure.
Figure 8B:
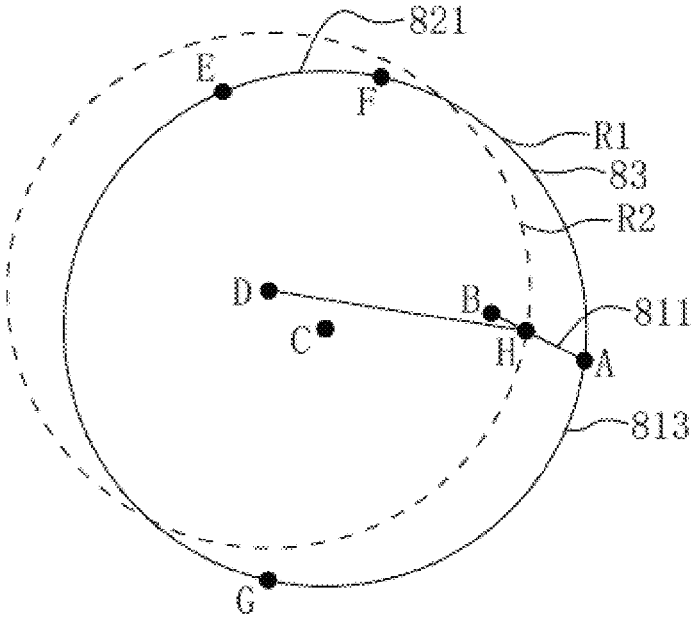
FIG. 8B is a simplified plan view when the toggling member in the counting member rotates with the second protrusion according to Embodiment 1 of the present disclosure.
Figure 9A:
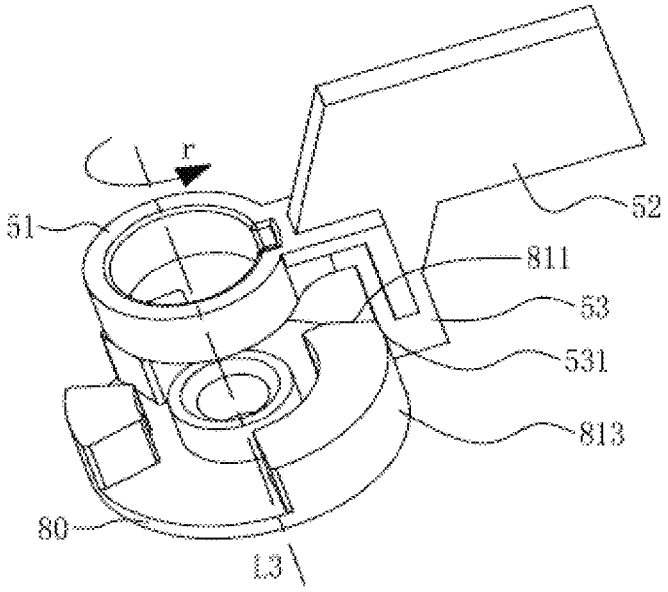
FIG. 9A is a status diagram illustrating a case in which the toggling member in the counting member is about to be held by the second protrusion according to Embodiment 1 of the present disclosure.
Figure 9B:
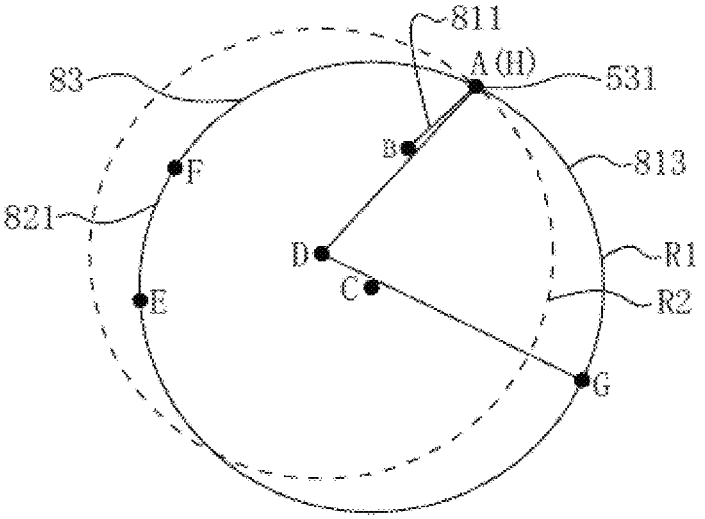
FIG. 9B is a simplified plan view illustrating a case in which the toggling member in the counting member is about to be held by the second protrusion according to Embodiment 1 of the present disclosure.

FIG. 7A is a perspective view of the counting member after a first holding period according to Embodiment 1 of the present disclosure. FIG. 7B is a simplified plan view of the counting member after the first holding period according to Embodiment 1 of the present disclosure. FIG. 8A is a status diagram illustrating a case in which the toggling member in the counting member rotates with a second protrusion according to Embodiment 1 of the present disclosure. FIG. 8B is a simplified plan view when the toggling member in the counting member rotates with the second protrusion according to Embodiment 1 of the present disclosure. FIG. 9A is a status diagram illustrating a case in which the toggling member in the counting member is about to be held by the second protrusion according to Embodiment 1 of the present disclosure. FIG. 9B is a simplified plan view illustrating a case in which the toggling member in the counting member is about to be held by the second protrusion according to Embodiment 1 of the present disclosure.

As shown in FIG. 7A, the starting surface 811 of the second protrusion 81 is in contact with the bump 53. At this time, the toggling member 5 stops moving along the direction opposite to the rotating direction r, and instead, is driven by the rotating member 8 to rotate along the direction r. As shown in FIG. 7B, the contact point H of the bump 53 (toggling member 5) and the starting surface 811 is located on the starting surface 811. As shown in FIGS. 8A and 8B, as the rotating member 8 rotates, the contact point H gradually moves away from the circle center C on the starting surface 811, namely gradually approaches the starting point A of the second protrusion 81, or in other words, the bump 53 is gradually disengaged from the starting surface 811. As shown in FIG. 9A, when the contact point H reaches the starting point A of the second protrusion 81, the inner surface 531 of the bump starts to contact the outer surface 813 of the second protrusion. At this time, the counted member 9 is pressed by the toggling plate 52 again, and under a reaction force of the counted member 9, the toggling member 5 tends to move along the direction opposite to the rotating direction r. As shown in FIG. 9B, the contact point H is at an intersection of the solid-line circle R1 and the dotted-line circle R2, and the second protrusion 81 prevents a moving tendency of the toggling member 5 along the direction opposite to the rotating direction r, therefore, the toggling member 5 remains stationary during the toggling member 5 is in contact with the second protrusion outer surface 813, and a distance DG from the circle center D of the toggling member 5 to the point G is greater than a distance DA from the circle center D to the point A. As the rotating member 8 rotates, the holding force applied by the second protrusion 81 to the toggling member 5 gradually increases. In this way, the toggling member 5 can be stably held in a stationary position where the counted member 9 is pressed by the toggling member 5, until the bump 53 is disengaged from the second protrusion 81.

Figure 10A:
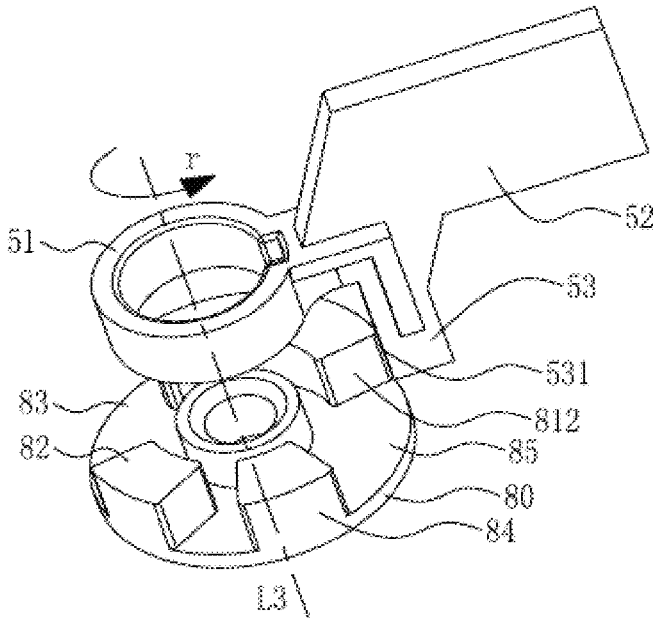
FIG. 10A is a status diagram illustrating a case in which the toggling member in the counting member is about to be disengaged from the second protrusion according to Embodiment 1 of the present disclosure.
Figure 10B:
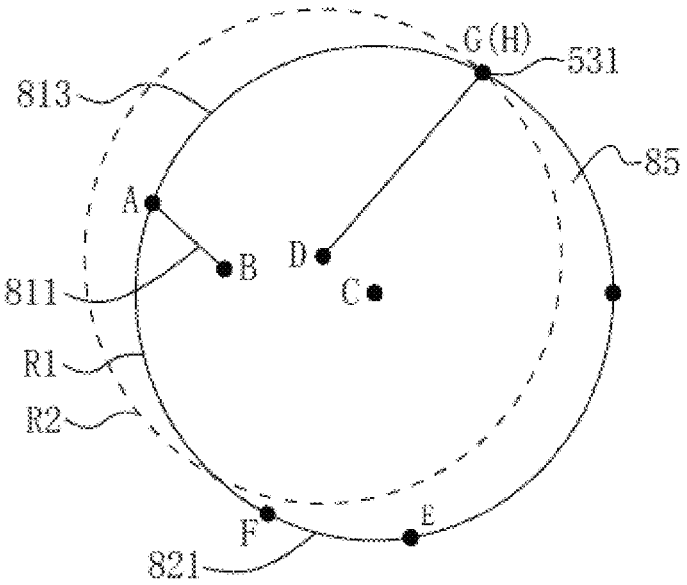
FIG. 10B is a simplified plan view illustrating a case in which the toggling member in the counting member is about to be disengaged from the second protrusion according to Embodiment 1 of the present disclosure.

FIG. 10A is a status diagram illustrating a case in which the toggling member in the counting member is about to be disengaged from the second protrusion according to Embodiment 1 of the present disclosure. FIG. 10B is a simplified plan view illustrating a case in which the toggling member in the counting member is about to be disengaged from the second protrusion according to Embodiment 1 of the present disclosure.

As shown in FIG. 10A, when the contact point H reaches the ending point G of the outer surface 813 of the second protrusion, the bump 53 is about to be disengaged from the second protrusion 81. Once the two no longer contact each other, the bump 53 will enter the second space 85. Under a reaction force of the counted member 9, the toggling member 5 moves along the direction opposite to the rotating direction r, until the bump 53 is in contact with the third protrusion 84. As the rotating member 8 continues to rotate, the bump 53 repeats the above-described motion process until the counting member K finishes counting.

As described above, the toggling member 5 is in contact with or disengaged from a plurality of protrusions of the rotating member 8 through the bumps 53, so that the toggling member 5 (toggling plate 52) is controlled by the rotating member 8 to remain stationary or move. That is, the developing box 1 further includes a holding member configured to control the toggling member 5 (toggling plate 52) to remain stationary. The holding member and the counting member K jointly form a counting assembly, and the holding member is in contact with the toggling member 5 and the rotating member 8 in the counting member, so that the rotating member 8 holds the toggling member 5 at a stationary position where the counted member 9 can be continuously pressed by the holding member. In an example, the holding member is configured to hold the toggling member 5 (toggling plate 52) in a stationary state according to the duration and the times that the counted member 9 is required to be pressed and the interval between two adjacent pressings. When the counted member 9 is not required to be pressed, the toggling member 5 (toggling plate 52) is disengaged from the counted member 9 under a reaction force of the counted member 9. In a process that the toggling member 5 contacts one of the protrusions of the rotating member 8, as the rotating member 8 rotates, the holding force applied by the rotating member 8 (protrusion) to the toggling member 5 gradually increases, so that the toggling member 5 can be stably held in a stationary position where the counted member 9 is pressed by the toggling member 5. The toggling member 5 remains being held until the toggling member 5 is disengaged from the protrusion.

According to this embodiment of the present disclosure, the holding member is provided in the counting member K, and includes a bump 53 provided on the toggling member 5 and a plurality of protrusions provided on the rotating member 8. The circle center D of a circle in which the bump 53 performs a circular motion is not concentric with the circle center C of a circle in which the plurality of protrusions perform a circular motion. That is, the protrusion 53 (toggling member 5) and the protrusions (rotating member 8) are eccentrically arranged, and a position where the bump 53 is in contact with the plurality of protrusions is located on or within a range of the circumference of a circle where the plurality of protrusions perform a circular motion. As shown in FIGS. 6B and 9B, a distance from the circle center D to the starting point of each protrusion is shorter than a distance from the circle center D to the ending point of the protrusion. In the above description, it is taken as an example for illustration that a solid-line circle R1 and a dashed-line circle R2 have a same radius. However, the solid-line circle R1 and the dashed-line circle R2 may have different radii, provided that the solid-line circle R1 and the dashed-line circle R2 are not arranged concentrically, and a position where the bump 53 is in contact with the plurality of protrusions is located on or within a range of the circumference of a circle where the plurality of protrusions perform a circular motion, and the above-mentioned function of the holding member can be achieved.

Embodiment 2

A difference between this embodiment and the above-mentioned embodiment lies in a structure of the holding member, and other identical parts will not be repeated herein.

The holding member in this embodiment includes an elastic member provided between the toggling member 5 and the rotating member 8 and a plurality of protrusions provided on the rotating member 8. The elastic member is, for example, a compression spring 10. Before the counting member K starts counting, or in other words, when the developing box 1 is just installed to the imaging device, the compression spring 10 is located between the toggling member 5 and a top surface 822 of the first protrusion 82 (as shown in FIG. 4A) and the compression spring 10 is compressed, so that the toggling member 5 can be held by the compression spring 10 to remain stationary so as to press the counted member 9.

As the rotating member 8 rotates, an end of the compression spring 10 which is in contact with the top surface 822 of the first protrusion slides on the top surface 822. During this process, the compression spring 10 continues to be in a compressed state. When the rotating member 8 rotates until the compression spring 10 no longer contacts the top surface 822 of the second protrusion, the compression spring 10 enters the first space 83 and extends, and at the same time, the toggling member 5 is no longer held and thus no longer presses the counted member 9. Under a reaction force of the counted member 9, the toggling member 5 rotates along the direction opposite to the rotating direction r, and then the compression spring 10 is compressed again by the second protrusion 81 to repeat the above-mentioned motion.

It can be seen that in this embodiment it is not required that a circle center of a circle where the compression spring 10 performs a circular motion is not concentric with a circle center of a circle where the plurality of protrusions perform a circular motion, provided that the compression spring 10 is engaged with the protrusion. When a circle center of a circle where the compression spring 10 performs a circular motion is not concentric with a circle center of a circle where the plurality of protrusions perform a circular motion, during a process that the toggling member 5 is in contact with one of the protrusions on the rotating member 8, as the rotating member 8 rotates, the holding force applied by the rotating member 8 (protrusion) to the toggling member 5 gradually increases.

In an example, a position where the compression spring 10 is contact with the protrusion may not be a top surface of the protrusion. For example, the compression spring 10 may also be in contact with an outer surface of the protrusion. Alternatively, a groove for receiving the compression spring 10 is provided at the top surface or the outer surface of the protrusion, so that a motion trajectory of the compression spring 10 trajectories is more stable.

Embodiment 3

Figure 11:
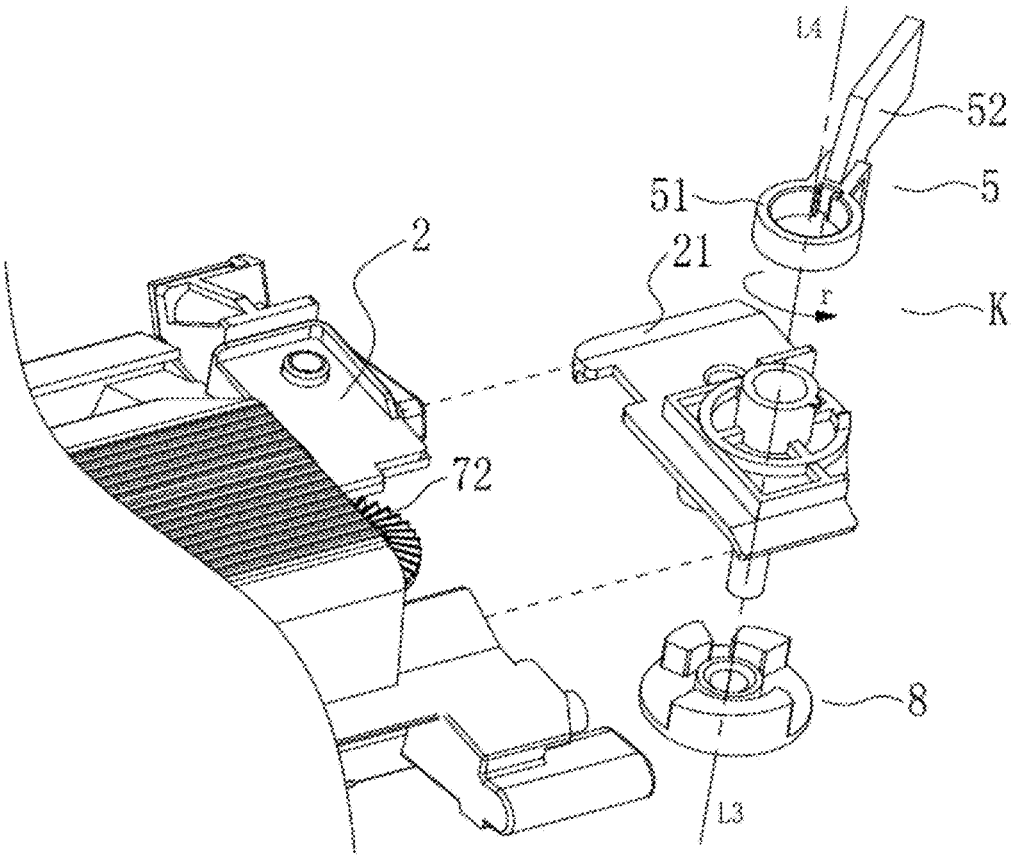
FIG. 11 is status diagram after a counting member in a developing box is disengaged from a housing of the developing box according to Embodiment 3 of the present disclosure.
Figure 12:
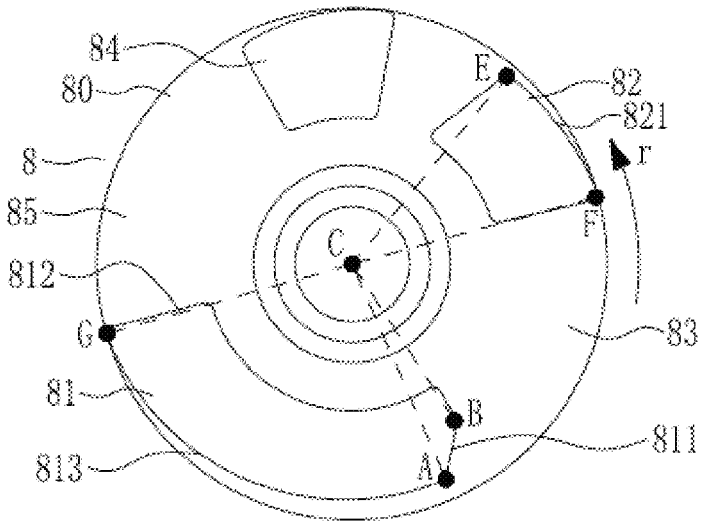
FIG. 12 is a top view of a rotating member in the counting member according to Embodiment 3 of the present disclosure.

FIG. 11 is status diagram after a counting member in a developing box is disengaged from a housing of the developing box according to Embodiment 3 of the present disclosure. FIG. 12 is a top view of a rotating member in the counting member according to Embodiment 3 of the present disclosure.

Compared with Embodiment 1, the rotating member 8 and the toggling member 5 in this embodiment are arranged coaxially, that is, the rotation axis L3 of the rotating member 8 is coaxial with the rotation axis L4 of the toggling member 5. Similarly, the rotating member 8 includes a rotating body 80 and a plurality of protrusions which are provided on the rotating body 80 and spaced from one another. As shown in FIG. 12, an ending point of each protrusion is farther away from the rotation center C than a starting point of the protrusion.

In this embodiment, it is also taken as an example that three protrusions (the first protrusion 82, the second protrusion 81 and the third protrusion 84) are provided on the rotating body 80. For example, the starting point E of the first protrusion 82 is closer to the rotation center C than the ending point F of the first protrusion 82, and the starting point A of the second protrusions 81 is closer to the rotation center C than the ending point G of the second protrusions 81, that is, each protrusion gradually approaches the rotation center C along the rotating direction r.

When the developing box 1 is installed to the imaging device, the bump 53 (the inner surface 531) is located at the starting point E of the first protrusion 82. As the rotating member 8 rotates, the outer surface 821 of the first protrusion 82 gradually moves away from the rotation center C. Therefore, the holding force applied by the rotating member 8 to the toggling member 5 also gradually increases. When the bump 53 (the inner surface) is located at a position (a position of the ending point F) where the first protrusion 82 is farthest away from the rotation center C, the holding force received by the toggling member 5 is the largest. During this process, the toggling member 5 is held in a stationary position where the counted member 9 is pressed by the holding force applied by the rotating member 8, until the bump 53 no longer contacts the first protrusion 82 and enters the first space 83. Under a reaction force of the counted member 9, the toggling member 5 moves along the direction opposite to the rotating direction r, and reaches a position where the toggling member 5 is in contact with the second protrusion 81.

In an example, in order to prevent the starting point of each protrusion from being in contact with the inner surface 531 of the bump, it is one of the solutions that the plurality of protrusions are arranged farther away from the rotation center C in a radial direction of the rotating body 80, along the rotating direction r of the rotating member 8.

In this embodiment, the bump 53 and the plurality of protrusions may be regarded as a holding member, and the rotating member 8 applies a holding force to the toggling member 5 through the holding member. During the process that the toggling member 5 contacts a protrusion, as the rotating member 8 rotates, the holding force applied by the rotating member 8 to the toggling member 5 gradually increases, so that the toggling member 5 can be stably held in a stationary position where the counted member 9 is pressed by the toggling member 5 until the bump 53 no longer contacts from the protrusion.

As an alternative, in the radial direction of the rotating member, each protrusion may protrude beyond the rotating body 80, and along the rotating direction r of the rotating member, a protruding extent of each protrusion decreases, or in other words, the starting point of each protrusion is closer to the rotation center C of the rotating member than the ending point of the protrusion.

As another alternative, the elastic member according to Embodiment 2 can also be applied to this embodiment. For example, the elastic member is installed to the bump 53, so that the bump 53 is in contact with the outer surface of the protrusion. At this time, the elastic member and the plurality of protrusions can be regarded as a holding member. Since the protrusions have the above-mentioned structure, during a process of the elastic member contacting a protrusion, as the rotating member 8 rotates, the holding force applied by the rotating member 8 to the toggling member 5 gradually increases, so that the toggling member 5 can be stably held in a stationary position where the counted member 9 is pressed by the toggling member 5 until the elastic member no longer contacts the protrusion.

Embodiment 4

Figure 13:
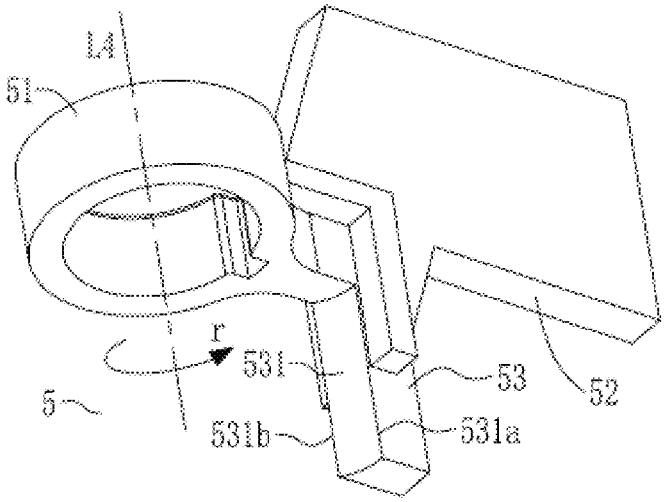
FIG. 13 is a perspective view of a toggling member according to Embodiment 4 of the present disclosure.

FIG. 13 is a perspective view of a toggling member according to Embodiment 4 of the present disclosure. This embodiment adopts the same reference signs to the identical components with the above embodiments.

In this embodiment, the rotating member 8 and the toggling member 5 are arranged in a coaxial manner, and the bump 53 and the protrusions of the rotating member 8 may be regarded as a holding member. The protrusions of the rotating member 8 are the same as those in Embodiment 1, but the bump 53 of the toggling member 5 is different from that in Embodiment 1. As shown in FIG. 13, along the rotating direction r, the inner surface 531 of the bump is configured to be not parallel to the rotation axis L4 of the toggling member 5. In an example, the inner surface 531 may be configured as an inclined surface or an arc surface. No matter what shape the inner surface 531 is configured as, along the rotating direction r, an upstream edge 531*a* of the inner surface 531 is farther away from the rotation axis L4 than a downstream edge 531*b* of the inner surface 531.

When the rotating member 8 starts to rotate, the protrusion first faces the upstream edge 531*a* of the inner surface, and as the rotating member 8 continues to rotate, the protrusion gradually starts to contact the downstream edge 531*b* of the inner surface. Therefore, the rotating member 8 applies a gradually increasing holding force to the toggling member 5 through the holding member, and the toggling member 5 can be stably held at a stationary position where the counted member 9 is pressed by the toggling member 5. When the bump 53 no longer contacts the protrusion, under a reaction force of the counted member 9, the toggling member 5 moves along the direction opposite to the rotating direction r.

As another alternative, the elastic member in Embodiment 2 can also be applied to this embodiment. For example, an elastic member which is capable of being in contact with the bump 53 is installed to each protrusion. In this case, the elastic member and the bump 53 can be regarded as a holding member. Since the bump 53 has the above-mentioned structure, in a process that the bump 53 is in contact with a protruding elastic member, as the rotating member 8 rotates, the holding force applied by the rotating member 8 to the toggling member 5 gradually increases, so that the toggling member 5 can be stably held at a stationary position where the counted member 9 is pressed by the toggling member 5 until the bump 53 no longer contacts the protruding elastic member.

Embodiment 5

This embodiment relates to a structure combining the rotating member 8 according to Embodiment 3 and the toggling member 5 according to Embodiment 4. The bump 53 and the protrusions of the rotating member 8 are regarded as a holding member.

As shown in FIGS. 12 and 13, for the first protrusion 82, when the rotating member 8 starts to rotate, the first protrusion 82 may not contact the inner surface 531 of the protrusion, but along the rotating direction r, the first protrusion 82 gradually moves away from the rotation center C, the inner surface 531 of the bump gradually approaches the rotation axis L4, and the rotation center C is located on the rotation axis L4. As the rotating member 8 rotates, the first protrusion 82 gradually starts to contact the inner surface 531 of the bump. Through the holding member, the rotating member 8 applies a gradually increasing holding force to the toggling member 5, and finally the toggling member 5 is stably held at a stationary position where the counted member 9 is pressed by the toggling member 5. When the bump 53 no longer contacts the protrusion, under a reaction force of the counted member 9, the toggling member 5 moves along the direction opposite to the rotating direction r.

Embodiment 6

In the above-mentioned embodiments, the toggling member 5 is held at a stationary position where the counted member 9 is pressed by changing the structure of at least one of the protrusion of the rotating member 8 and the inner surface 531 of the toggling member 5. However, alternatively, it can also be achieved by changing a material of at least one of the protrusion and the inner surface 531 of the toggling member 5.

Different from the addition of the elastic member in Embodiment 2, in this embodiment, when the rotating member 8 and the toggling member 5 are coaxial, at least one of the outer surface of each protrusion and the inner surface 531 of the bump is configured to be elastic. As the rotating member 8 rotates, the toggling member 5 is held at a stationary position where the counted member 9 is pressed through a static friction force between the outer surface of each protrusion and the inner surface 531 of the bump. Likewise, the protrusions and the bump 5 may still be regarded as a holding member. When the rotating member 8 rotates, a static friction force is generated between the protrusion and the inner surface 531 of the bump, and the static friction force, as a holding force, to keep the toggling member 5 at a stationary position where the counted member 9 is pressed by the toggling member 5. That is, the holding force of the toggling member 5 pressing the counted member 9 is applied by the rotating member through the holding member. When the bump 53 no longer contacts the protrusion, the toggling member 5 moves along the direction opposite to the rotating direction r under a reaction force of the counted member 9.

In an example, along the rotating direction r, the holding force applied by the rotating member 8 to the toggling member 5 gradually increases during the process in which the bump 53 is in contact with each protrusion. For example, along the rotating direction r, the static friction force between the downstream portion of each protrusion and the inner surface 531 of the bump is smaller than the static friction force between the upstream portion of the protrusion and the inner surface 531 of the bump, or in other words, along the rotating direction r, a static friction force between the upstream edge 531*a* of the inner surface 531 of the bump and each protrusion is smaller than a static friction force between the downstream edge 531*b* of the inner surface 531 of the bump and each protrusion, thus, the toggling member 5 can be stably held at a stationary position where the counted member 9 is pressed by the toggling member 5.

In the embodiments of the present disclosure, the times that the counted member 9 is pressed can be defined by the number of protrusions provided at the rotating member 8, and a duration of the period that the counted member 9 is pressed can be defined by an arc length of the protrusion, and the interval at which the counted member 9 is pressed can be defined by the space between two adjacent protrusions. Therefore, for the counting member K according to the present disclosure, the number and the arc length of protrusions and the space between two adjacent protrusions can be defined based on a service life of the developing box 1 and a requirement when the imaging device identifies the developing box 1. As described above, the developing box 1 is provided with a holding member located in the counting member K, and the holding member is in contact with the rotating member 8 and the toggling member 5 in the counting member. During the counting process of the counting member K, the rotating member 8 applies a gradually increasing holding force to the toggling member 5 through the holding member so as to keep the toggling member 5 at a stationary position where the counted member 9 can be continuously pressed, thereby ensuring the accuracy of the counting member K and reducing a risk of counting failure.

What is claimed is:

1. A counting assembly, comprising:

a counting member capable of being engaged with and disengaged from a counted member that is arranged outside the counted member, wherein the counting member comprises a rotating member and a toggling member separated from each other, the rotating member rotates by receiving an external driving force, and the rotating member drives the toggling member to rotate; and a holding member in contact with the rotating member and the toggling member, wherein during a counting process, the rotating member applies a discontinuous force to the toggling member through the holding member; and when the toggling member is subjected to the discontinuous force, the toggling member is held at a stationary position where the counted member is continuously pressed by the holding member, and when the toggling member is not subjected to the discontinuous force, the toggling member rotates along a direction opposite to a rotating direction of the rotating member under a reaction force of the counted member.

2. The counting assembly according to claim 1, wherein during a process that the rotating member applies the discontinuous force to the toggling member through the holding member, as the rotating member rotates, the discontinuous force applied by the rotating member to the toggling member increases.

3. The counting assembly according to claim 2, wherein the holding member comprises protrusions which are provided at the rotating member and spaced from one another and a bump provided at the toggling member, and during a rotating process of the rotating member, when the bump is in contact with the protrusions, the rotating member transmits the discontinuous force to the toggling member, and when the bump is not in contact with the protrusions, the rotating member does not transmit the discontinuous force to the toggling member.

4. The counting assembly according to claim 3, wherein when the bump and the protrusions are eccentrically arranged, the bump is in contact with an outer surface of one of the protrusions, and a contact point of the bump and the outer surface of one of the protrusions is within a circumference of the rotating member.

5. The counting assembly according to claim 3, wherein along the rotating direction of the rotating member, a starting point of each of the protrusions is closer to a rotation center of the rotating member than an ending point of the protrusion.

6. The counting assembly according to claim 3, wherein the protrusions are provided at a rotating body of the rotating member, the protrusions extend beyond the rotating body in a radial direction of the rotating member, and a protruding extent of each of the protrusions decreases along the rotating direction of the rotating member.

7. The counting assembly according to claim 3, wherein a surface on which the bump and one of the protrusions are in contact with each other is configured in such a manner that, an upstream edge of the surface is farther away from a rotation axis of the toggling member than a downstream edge of the surface along a rotating direction of the toggling member when the rotating member drives the toggling member to rotate.

8. The counting assembly according to claim 3, wherein a surface on which the bump and one of the protrusions are in contact with each other is configured to be an inclined surface or an arc surface which is not parallel to a rotation axis of the toggling member.

9. The counting assembly according to claim 3, wherein at least one of a surface on which the bump and one of the protrusions are in contact with each other and an outer surface of one of the protrusions is configured to be elastic, and when the rotating member rotates, the toggling member is held at a stationary position where the counted member is pressed by the toggling member through a static friction force between the rotating member and the toggling member.

10. The counting assembly according to claim 9, wherein along the rotating direction of the rotating member, a static friction force between a downstream portion of each of the protrusions and the bump is smaller than a static friction force between an upstream portion of the protrusion and an inner surface of the bump.

11. The counting assembly according to claim 9, wherein along a rotating direction of the toggling member when the rotating member drives the toggling member to rotate, a static friction force between an upstream edge of a surface of the bump which is in contact with one of the protrusions and the protrusion is smaller than a static friction force between a downstream edge of the surface of the bump and the protrusion.

12. The counting assembly according to claim 3, wherein a distance from a circle center of the toggling member to a starting point of each of the protrusions is shorter than a distance from a circle center of the toggling member to an ending point of the protrusion.

13. The counting assembly according to claim 12, wherein along the rotating direction of the rotating member, each of the protrusions comprises a starting surface located at the most downstream and an ending surface located at the most upstream, and the starting surface of each of the protrusions is configured in such a manner that an endpoint of the starting surface close to a rotation center of the rotating member is located downstream of another endpoint of the starting surface away from the rotation center of the rotating member.

14. The counting assembly according to claim 3, wherein an elastic member provided between the rotating member and the toggling member, and the elastic member is in contact with the protrusions and the toggling member.

15. The counting assembly according to claim 14, wherein a circle center of a circle along which the elastic member performs a circular motion is not concentric with a center of a circle along which the protrusions perform a circular motion.

16. The counting assembly according to claim 14, wherein along the rotating direction of the rotating member, a starting point of each of the protrusions is closer to a rotation center of the rotating member than an ending point of the protrusion.

17. The counting assembly according to claim 14, wherein a surface on which the bump and one of the protrusions are in contact with each other is configured in such a manner that, an upstream edge of the surface is farther away from a rotation axis of the toggling member than a downstream edge of the surface along a rotating direction of the toggling member when the rotating member drives the toggling member to rotate.

18. A developing box comprising a housing and a power receiving member located at a longitudinal end of the housing, wherein the developing box further comprises a counting assembly, and a driving force required by the counting assembly during operation is received from the power receiving member, wherein the counting assembly comprises:

a counting member capable of being engaged with and disengaged from a counted member that is arranged outside the counted member, wherein the counting member comprises a rotating member and a toggling member separated from each other, the rotating member rotates by receiving an external driving force, and the rotating member drives the toggling member to rotate; and a holding member in contact with the rotating member and the toggling member, wherein during a counting process, the rotating member applies a discontinuous force to the toggling member through the holding member; and when the toggling member is subjected to the discontinuous force, the toggling member is held at a stationary position where the counted member is continuously pressed by the holding member, and when the toggling member is not subjected to the discontinuous force, the toggling member rotates along a direction opposite to a rotating direction of the rotating member under a reaction force of the counted member.

19. The counting assembly according to claim 18, wherein during a process that the rotating member applies the discontinuous force to the toggling member through the holding member, as the rotating member rotates, the discontinuous force applied by the rotating member to the toggling member increases.

20. The counting assembly according to claim 19, wherein the holding member comprises protrusions which are provided at the rotating member and spaced from one another and a bump provided at the toggling member, and during a rotating process of the rotating member, when the bump is in contact with the protrusions, the rotating member transmits the discontinuous force to the toggling member, and when the bump is not in contact with the protrusions, the rotating member does not transmit the discontinuous force to the toggling member.

* * * * *